US009583287B2

(12) United States Patent
Zheng

(10) Patent No.: US 9,583,287 B2
(45) Date of Patent: Feb. 28, 2017

(54) SWITCH DEVICE

(71) Applicant: WISTRON CORPORATION, New Taipei (TW)

(72) Inventor: Yong-Liang Zheng, New Taipei (TW)

(73) Assignee: Wistron Corporation, New Taipei (TW)

( * ) Notice: Subject to any disclaimer, the term of this patent is extended or adjusted under 35 U.S.C. 154(b) by 114 days.

(21) Appl. No.: 14/326,880

(22) Filed: Jul. 9, 2014

(65) Prior Publication Data

US 2015/0213975 A1 Jul. 30, 2015

(30) Foreign Application Priority Data

Jan. 28, 2014 (CN) ..... 2014 2 0056540 U

(51) Int. Cl.

| | |
|---|---|
| ***H01H 13/58*** | (2006.01) |
| ***H01H 3/34*** | (2006.01) |
| ***H01H 13/83*** | (2006.01) |
| ***H01H 13/86*** | (2006.01) |
| ***H01H 13/80*** | (2006.01) |
| ***H01H 9/16*** | (2006.01) |
| ***H01H 13/02*** | (2006.01) |

(52) U.S. Cl.

CPC ..... *H01H 13/83* (2013.01); *H01H 9/161* (2013.01); *H01H 13/023* (2013.01); *H01H 13/58* (2013.01); *H01H 13/80* (2013.01); *H01H 13/86* (2013.01); *H01H 2219/036* (2013.01); *H01H 2219/039* (2013.01); *H01H 2221/01* (2013.01); *H01H 2221/024* (2013.01); *H01H 2221/036* (2013.01); *H01H 2223/00* (2013.01)

(58) Field of Classification Search

CPC ..... H01H 13/58; H01H 13/56; H01H 13/585; B43K 24/16; B43K 21/006

USPC ..... 200/526, 5 A, 310–314, 11 R, 527; 361/230, 231; 315/193, 185 S

See application file for complete search history.

(56) References Cited

U.S. PATENT DOCUMENTS

| | | | | |
|---|---|---|---|---|
| 4,274,102 A * | 6/1981 | Lum | ..... | B43K 24/10 33/18.1 |
| 4,891,476 A * | 1/1990 | Nation | ..... | H01H 13/585 200/11 R |
| 5,043,546 A * | 8/1991 | Krause | ..... | H01H 13/58 200/283 |

(Continued)

FOREIGN PATENT DOCUMENTS

| | | |
|---|---|---|
| TW | M370169 U1 | 12/2009 |
| TW | M402799 U1 | 5/2011 |

*Primary Examiner* — Renee S Luebke
*Assistant Examiner* — Ahmed Saeed
(74) *Attorney, Agent, or Firm* — Jianq Chyun IP Office

(57) ABSTRACT

A switch device includes a circuit module and a pressing module. The circuit module includes a plurality of pushbuttons and a light-emitting member that emits light having different colors when the pushbuttons are pressed. The pressing module includes an operating unit, a driven member and a pressing member. The driven member is moved alternately to a retracted position and a projecting position as a result of depression of the operating unit. The pressing member is connected to the driven member to press one of the pushbuttons when the driven member is at the projecting position, such that one of the colors of the light corresponding to the one of the pushbuttons is visible through the operating unit.

16 Claims, 12 Drawing Sheets

(56) References Cited

U.S. PATENT DOCUMENTS

| | | | | |
|---|---|---|---|---|
| 5,713,680 | A * | 2/1998 | Yoshino | B43K 24/183 401/30 |
| 5,813,519 | A * | 9/1998 | Gotoh | H01H 15/025 200/313 |
| 6,994,484 | B2 * | 2/2006 | Kageyama | B43K 21/06 401/30 |
| 8,147,158 | B2 * | 4/2012 | Nanos | B43K 5/16 401/104 |
| 2003/0173198 | A1 * | 9/2003 | Hanahara | H01H 13/702 200/314 |
| 2005/0122712 | A1 * | 6/2005 | Kim | F21L 4/027 362/184 |
| 2010/0098477 | A1 * | 4/2010 | Lee | B43K 24/084 401/103 |
| 2012/0140452 | A1 * | 6/2012 | Martinez | A41D 27/085 362/103 |
| 2014/0202841 | A1 * | 7/2014 | Srbinovski | H01H 3/34 200/526 |

* cited by examiner

SWITCH DEVICE

CROSS-REFERENCE TO RELATED APPLICATION

This application claims priority of Chinese Application No. 201420056540.7, filed on Jan. 28, 2014, the disclosure of which is incorporated herein by reference.

BACKGROUND OF THE DISCLOSURE

1. Field of the Disclosure

The disclosure relates to a switch device, more particularly to a switch device that is used in an electronic apparatus.

2. Description of the Related Art

A conventional switch is used in an electronic apparatus for switching functions of the electronic apparatus. For example, the conventional switch may have a circulation including four press operations to switch two functions of the electronic apparatus. Wherein, the conventional switch turns on the first function of the electronic apparatus via the first depression, and turns off the first function via the second depression. Likewise, the conventional switch turns on the second function of the electronic apparatus via the third depression, and turns off the second function via the fourth depression.

However, the function that the electronic apparatus is performing cannot be indicated by the conventional switch, and must be shown by a display interface coupled to the electronic apparatus.

SUMMARY OF THE DISCLOSURE

Therefore, the object of the present disclosure is to provide a switch device that is used in an electronic apparatus and that switches and indicates a status of the electronic apparatus.

Accordingly, a switch device of the present disclosure includes a circuit module and a pressing module. The circuit module includes a circuit board, a light-emitting member that is disposed on the circuit board, and a plurality of angularly spaced-apart pushbuttons that are disposed on the circuit board, and that surround the light-emitting member. The pushbuttons are capable of being pressed to activate the light-emitting member to emit light having different colors that correspond respectively to the pushbuttons. The pressing module includes a casing, an operating unit, a driven unit and a pressing member. The casing defines a through hole therethrough. The through hole extends along an axis and has first and second end openings that are opposite to each other along the axis. The through hole is aligned with the light-emitting member. The second end opening is disposed between the first end opening and the light-emitting member. The operating unit is partially mounted in and movable along the through hole, and includes an operating section disposed outwardly of the through hole near the first end opening for being pressed. The operating section is at least partially transparent. The driven unit includes a driven member that is mounted in the through hole, and that is movable along and rotatable about the axis. The operating unit pushes the driven member upon pressing the operating section. The driven member rotates by a rotational angle in response to each depression of the operating section, and is moved alternately to a retracted position and a projecting position as a result of rotating by the rotational angle. The retracted position is closer to the first end opening than the projecting position. The pressing member is connected fixedly to the driven member, and has a pressing section disposed outwardly of the through hole near the second end opening. The pressing section presses one of the pushbuttons when the driven member is at the projecting position, such that one of the colors of the light corresponding to the one of the pushbuttons is visible through the operating section of the operating unit. The pressing section is spaced apart from the pushbuttons when the driven member is at the retracted position.

BRIEF DESCRIPTION OF THE DRAWINGS

Other features and advantages of the present disclosure will become apparent in the following detailed description of the embodiment with reference to the accompanying drawings, of which.

DETAILED DESCRIPTION OF THE EMBODIMENT

Figure 1:
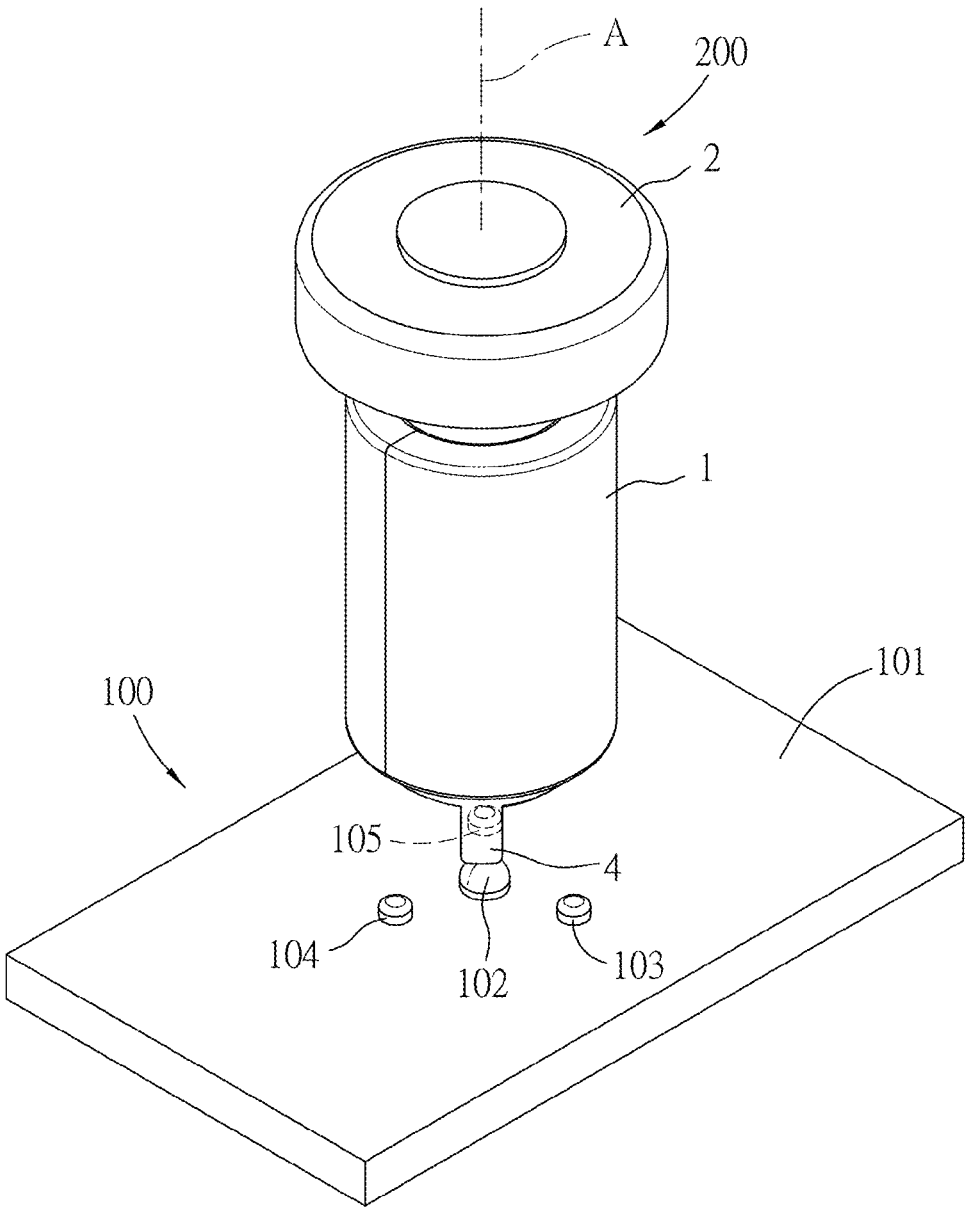
FIG. 1 is a perspective view of an embodiment of a switch device according to the disclosure.
Figure 2:
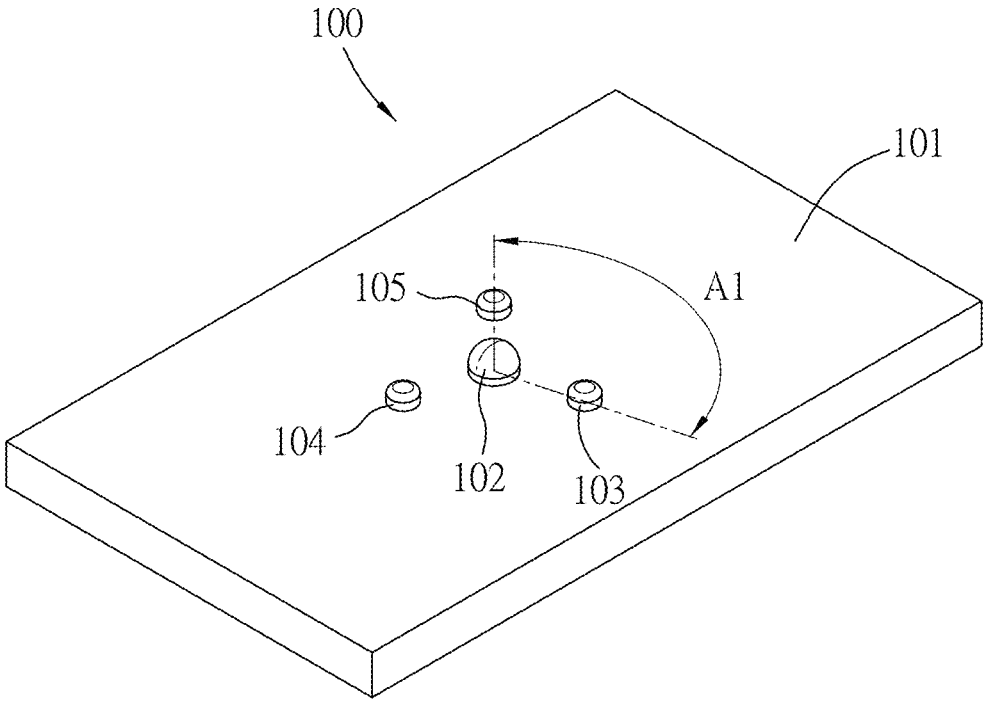
FIG. 2 is a perspective view of a circuit module of the embodiment.

As shown in FIGS. 1 and 2, an embodiment of a switch device according to the present disclosure is used in an electronic apparatus (not shown) for switching functions of the electronic apparatus. The switch device includes a circuit module 100 and a pressing module 200.

The circuit module 100 includes a circuit board 101, a light-emitting member 102 disposed on the circuit board 101, and a plurality of pushbuttons 103, 104, 105 disposed on the circuit board 101. The pushbuttons 103, 104, 105 surround the light-emitting member 102, are angularly spaced apart from each other by a first angle (A1), and are capable of being pressed to activate the light-emitting member 102 to emit light having different colors that correspond respectively to the pushbuttons 103, 104, 105. In this embodiment, specifically, there are three pushbuttons 103, 104, 105, and the first angle (A1) is 120 degrees. When a pushbutton 103 is pressed, it activates the electronic apparatus to perform a first function, and activates the light-emitting member 102 to emit light having a specific color, say, blue. When another pushbutton 104 is pressed, it activates the electronic apparatus to perform a second function, and activates the light-emitting member 102 to emit light having another specific color, say, red. When yet another pushbutton 105 is pressed, it activates the electronic apparatus to perform a third function, and activates the light-emitting member 102 to emit light having yet another specific color, say, green. As such, a status of the electronic apparatus is indicated by the color of the light emitted by the light-emitting member 102.

Figure 3:
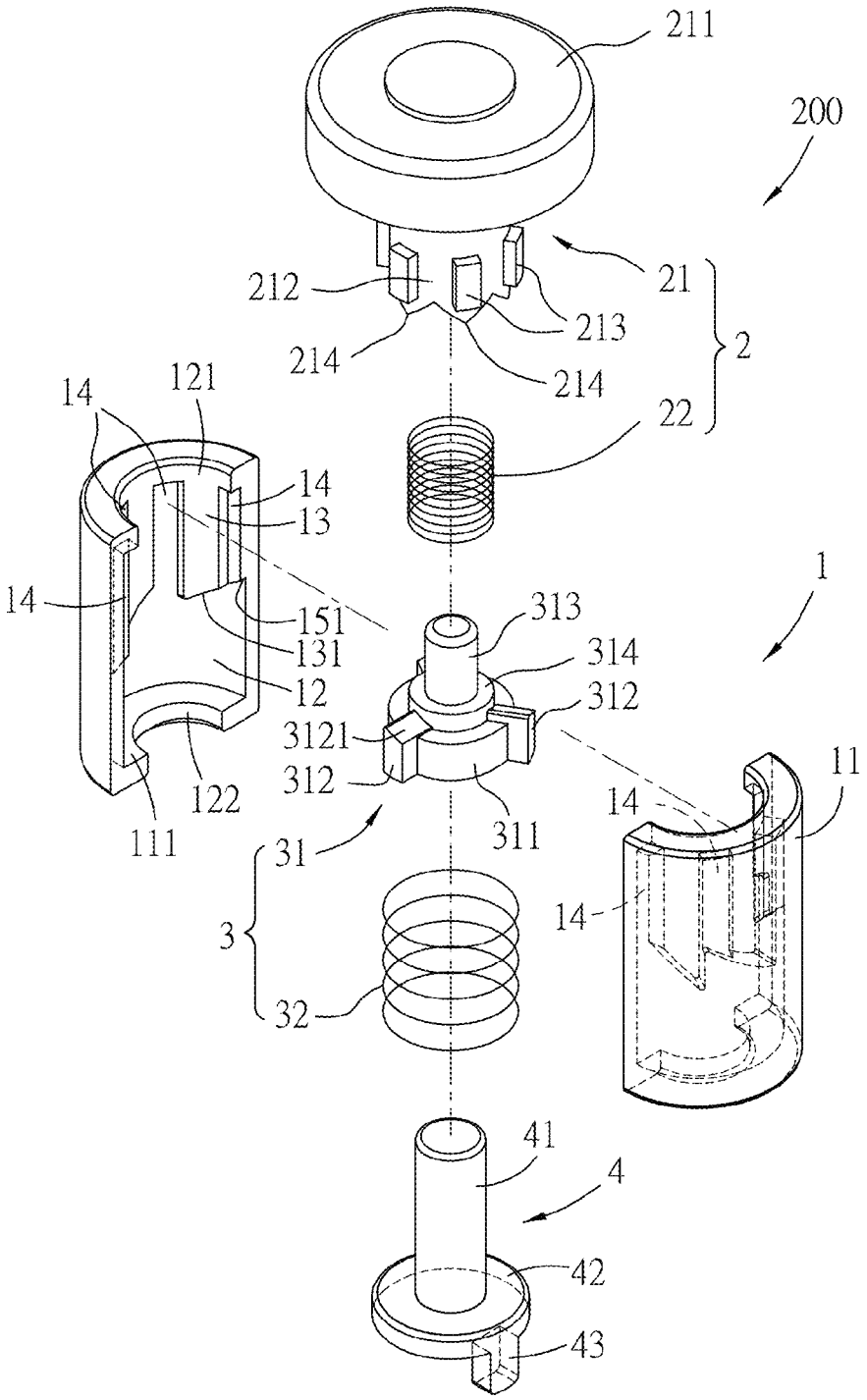
FIG. 3 is an exploded perspective view of a pressing module of the embodiment.
Figure 4:
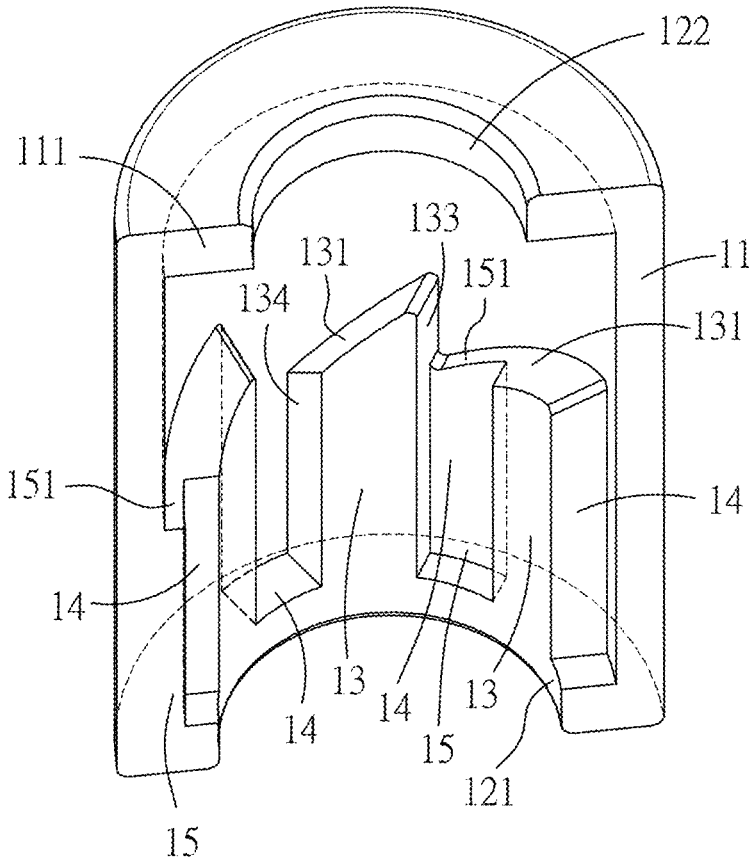
FIG. 4 is a perspective schematic view of a casing half of the pressing module of the embodiment.
Figure 5:
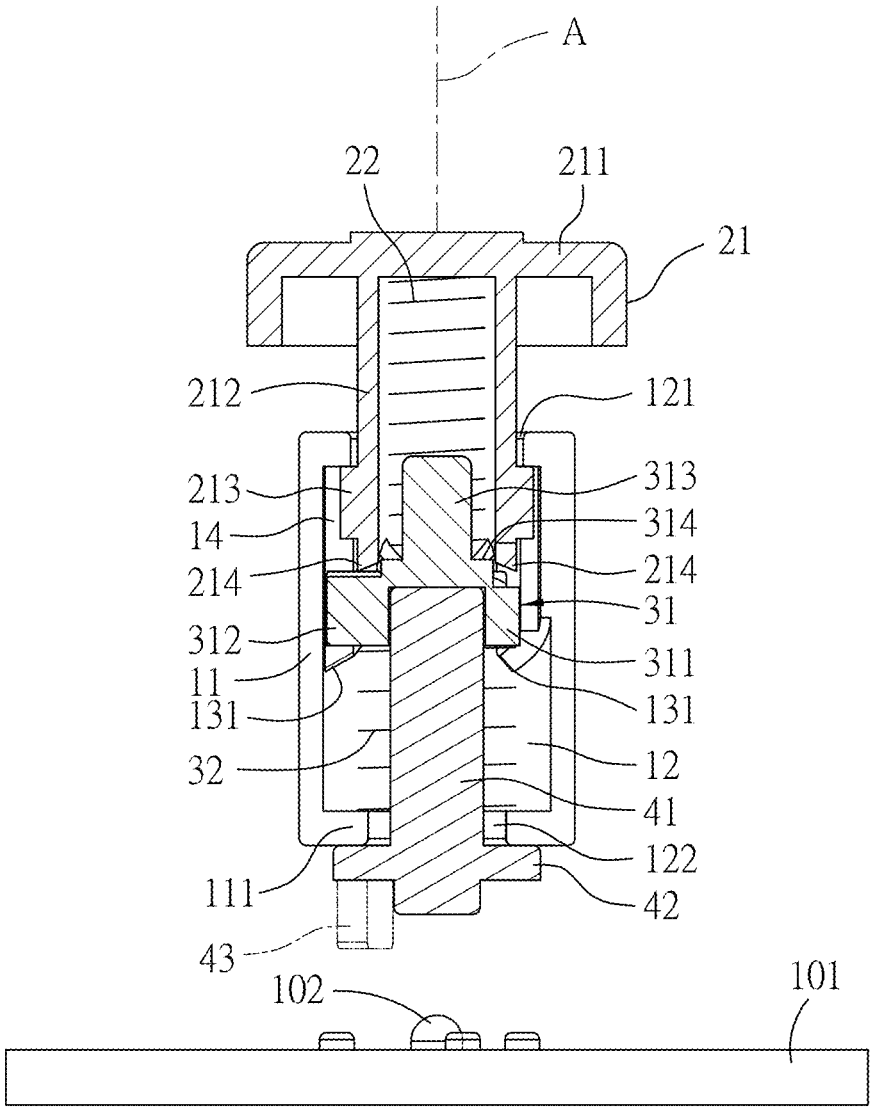
FIG. 5 is a sectional view of the pressing module, illustrating a pressing member of the pressing module at a normal position.

Referring further to FIGS. 3 to 5, the pressing module 200 includes a casing 1, an operating unit 2, a driven unit 3 and a pressing member 4.

The casing 1 has a surrounding wall 11 that has an inner surrounding surface defining a through hole 12. The through hole 12 extends through the casing 1 along an axis (A), and has first and second end openings 121, 122 that are opposite to each other along the axis (A). The through hole 12 is aligned with the light-emitting member 102. The second end opening 122 is disposed between the first end opening 121 and the light-emitting member 102. The casing 1 further has a plurality of angularly spaced-apart guide ribs 13 that are formed on the inner surrounding surface of the surrounding wall 11. Each of the guide ribs 13 extends from a position proximate to the first end opening 121 toward the second end opening 122 in a direction parallel to the axis (A), and has a spirally-extending end surface 131 that faces toward the second end opening 122, a long lateral side surface 133, and a short lateral side surface 134. Any two adjacent ones of the guide ribs 13 cooperatively define a guide groove 14 therebetween. The guide grooves 14 between the guide ribs 13 are divided into deep ones, and shallow ones that are shallower than the deep ones in a radial direction of the through hole 12 (see FIG. 10). The deep ones and shallow ones of the guide grooves 14 are disposed in alternating arrangement. The casing 1 further has a plurality of connecting walls 15 that are formed on the inner surrounding surface of the surrounding wall 11. Each of the connecting walls 15 is connected between and thinner than two adjacent ones of the guide ribs 13. Each of the connecting walls 15 defines a bottom wall surface of a respective one of the shallow ones of the guide grooves 14. Each of the connecting walls 15 has a spirally-extending end surface 151 that faces toward the second end opening 122 and that is connected to the end surface 131 of one of the two adjacent ones of the guide ribs 13.

The operating unit 2 is partially mounted in and movable along the through hole 12, and includes an operating member 21 and a resilient member 22. In this embodiment, the resilient member 22 is configured as a compression spring. The operating member 21 has an operating section 211, a tubular section 212 and a plurality of angularly spaced-apart sliding blocks 213. The operating section 211 is disposed outwardly of the through hole 12 near the first end opening 121 for being pressed, and is at least partially transparent. The tubular section 212 is partially disposed in the through hole 12 of the casing 1, and has an end that is connected to the operating section 211, and an opposite end that is opposite to the operating section 211 and that is formed with a plurality of sharp teeth 214. The sliding blocks 213 protrude radially and outwardly from the tubular section 212, correspond respectively in angular position to the teeth 214, and are retained respectively and slidably in the guide grooves 14 so as to guide the operating member 21 to move along the axis (A).

The driven unit 3 includes a driven member 31 and a resilient member 32. In this embodiment, the resilient member 32 is configured as a compression spring. The driven member 31 is mounted in the through hole 12, is movable along and rotatable about the axis (A), and includes a ring body 311, a plurality of angularly spaced-apart protruding blocks 312, a cylindrical section 314 and a column section 313. The protruding blocks 312 protrude radially and outwardly from the ring body 311. A protruding length of each of the protruding blocks 312 in the radial direction of the through hole 12 is substantially equal to the depth of the deep ones of the guide grooves 14, and is greater than the depth of the shallow ones of the guide grooves 14. Each of the protruding blocks 312 has a spirally-extending end surface 3121 that faces toward the first end opening 121. The cylindrical section 314 has an outer periphery connected to an inner periphery of the ring body 311 and is located between the ring body 311 and the operating section 211 of the operating member 21. The column section 313 extends from a central portion of the cylindrical section 314 toward the operating section 211. The resilient member 22 of the operating unit 2 is received in the tubular section 212 of the operating member 21, and is sandwiched between the cylindrical section 314 of the driven member 31 and the operating section 211 of the operating member 21. The column section 313 extends into the resilient member 22 of the operating unit 2.

The pressing member 4 has a rod section 41, a flange section 42 and a pressing section 43. The rod section 41 has a first end connected fixedly to the driven member 31, and a second end opposite to the driven member 31 and projecting out of the through hole 12 via the second end opening 122. The flange section 42 extends radially and outwardly from the second end of the rod section 41. The pressing section 43 is disposed outwardly of the through hole 12 near the second end opening 122, and projects from an outer periphery of the flange section 42 in a direction away from the driven member 31. The casing 1 is formed with an inner flange 111. The resilient member 32 of the driven unit 3 surrounds the rod section 41 of the pressing member 4, and is sandwiched between the driven member 31 and an inner flange 111 of the casing 1 for urging the driven member 31 toward the first end opening 121.

In this embodiment, the casing 1 is formed by two casing halves. The casing halves are interconnected through ultrasonic welding after the other components of the pressing module 200 are assembled.

Figure 6:
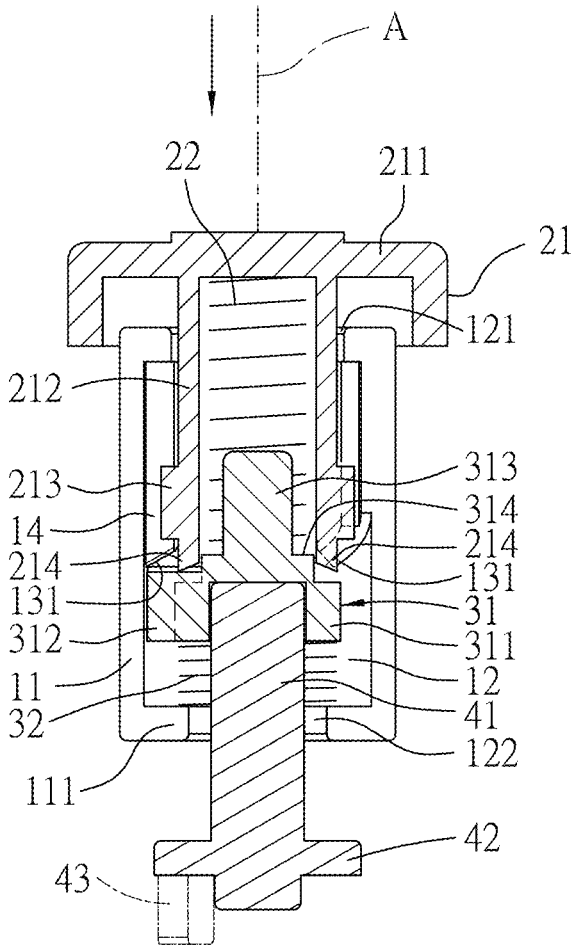
FIG. 6 is another sectional view of the pressing module, illustrating the pressing member at a pressed position.

The operating member 21 is movable along the axis (A) between a normal position (see FIG. 5) where the teeth 214 are farther from the second end opening 122 than the end surfaces 131 of the guide ribs 13, and a pressed position (see FIG. 6) where the teeth 214 are closer to the second end opening 122 than the end surfaces 131 of the guide ribs 13. The resilient member 22 of the operating unit 2 biases the operating member 21 toward the normal position.

Figure 7:
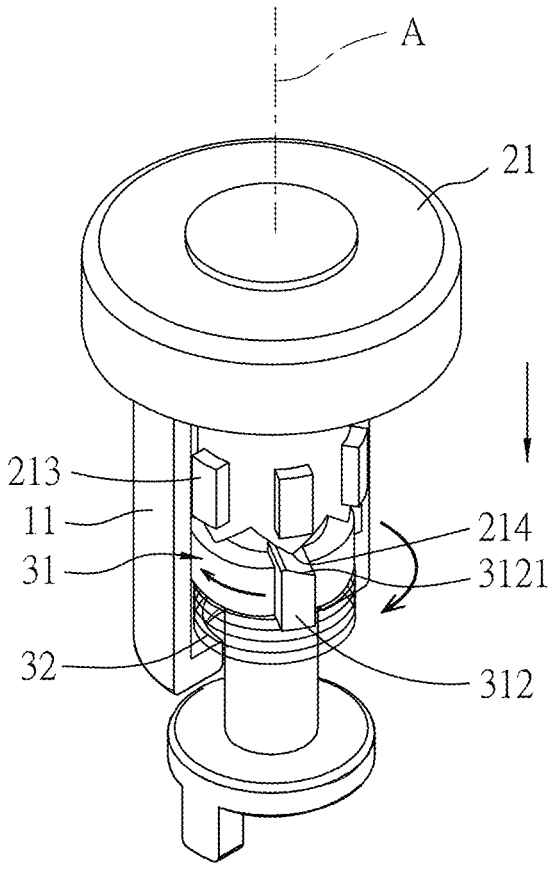
FIG. 7 is a fragmentary perspective schematic view of the pressing module, illustrating the pressing member being pressed toward the pressed position for driving rotation of a driven member.
Figure 8:
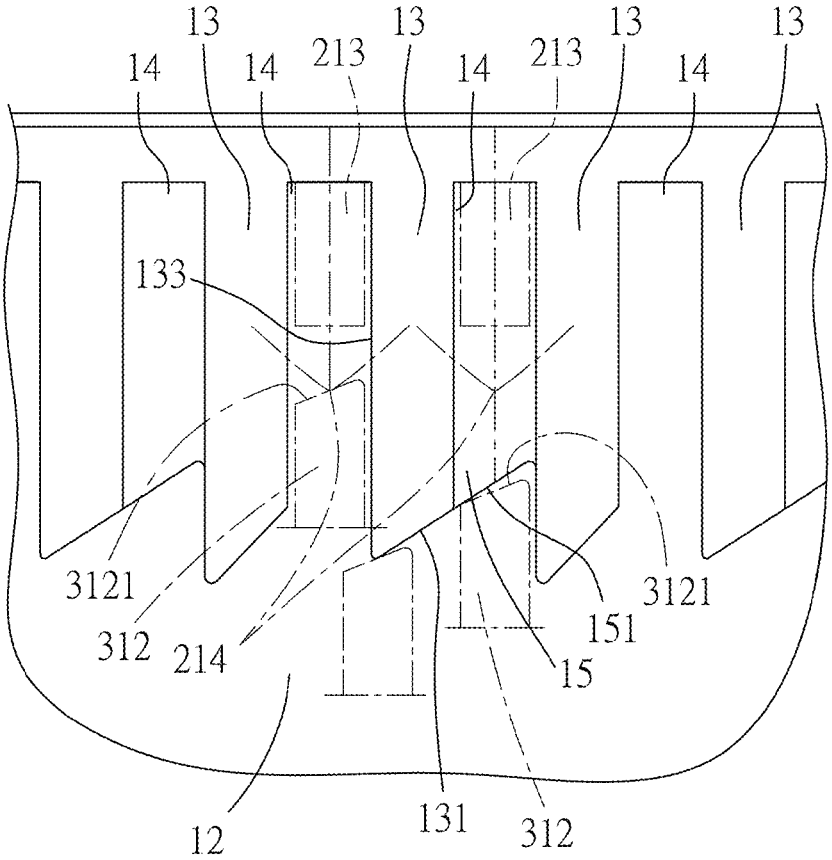
FIG. 8 is a fragmentary schematic view, illustrating movement of a protruding block of the driven member in the casing.
Figure 9:
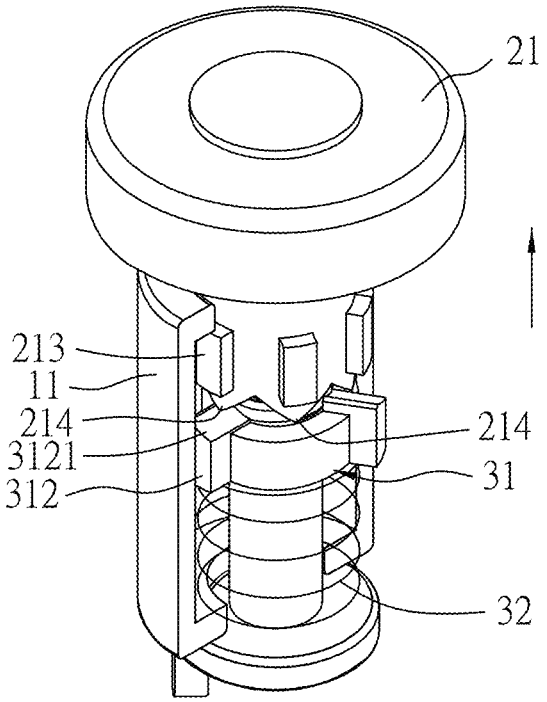
FIG. 9 is another perspective schematic view of the pressing module, illustrating the operating member at the normal position.

FIG. 8 illustrates movement of one of the protruding blocks 312 during a depression of the operating member 21 (see FIG. 7). Initially, the protruding block 312 is received in one of the deep ones of the guide grooves 14, and the operating member 21 is at the normal position. Since the driven member 31 is urged toward the first end opening 121 by the resilient member 32 (see FIG. 5), the end surface 3121 of the protruding block 312 is urged to abut against one of the teeth 214 of the operating member 21, so that the protruding block 312 tends to rotate about the axis (A) to abut against the long lateral side surface 133 of one of the guide ribs 13 due to the geometric configurations of the end surface 3121 and the one of the teeth 214. When the operating member 21 is pressed to move toward the pressed position (see FIG. 7), the one of the teeth 214 pushes the protruding block 312 to move toward the second end opening 122 along the axis (A). When the operating member 21 moves to the pressed position, the protruding blocks 312 is pushed to pass past the lateral side surface 133 of the one of the guide ribs 13 by the one of the teeth 214, and rotates about the axis (A). Since the protruding length of the protruding block 312 in the radial direction of the through hole 12 is greater than the depth of the shallow ones of the guide grooves 14, the protruding block 312 cannot enter the shallow ones of the guide grooves 14. When the operating member 21 is released (see FIG. 9), the end surface 3121 of the protruding block 312 is urged by the resilient member 32 to move onto the end surfaces 131 of the one of the guide ribs 13 and the end surface 151 of one of the connecting wall 15 connected to the one of the guide ribs 13 to drive further rotation of the driven member 31 until the protruding block 312 is moved to a position that corresponds in angular position to one of the shallow ones of the guide groove 14, and abuts against the long lateral side surface 133 of another one of the guide ribs 13 connected to the one of the connecting wall 15 and the end surface 151 of the one of the connecting wall 15. The driven member 31 rotates by a rotational angle (A2) in response to the depression of the operating section 211 of the operating member 21. In this embodiment, the rotational angle (A2) is 60 degrees.

Likewise, during the next depression of the operating member 21, the driven member 31 also rotates by the rotational angle (A2). The protruding block 312 is moved to a position that corresponds in angular position to another one of the deep ones of the guide groove 14.

Figure 10:
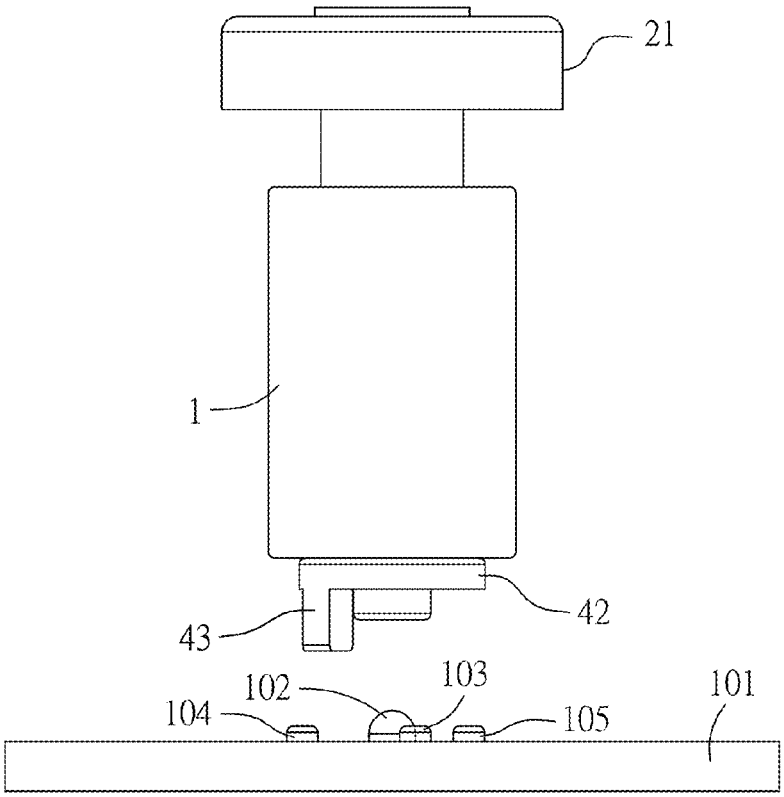
FIG. 10 is a side view of the embodiment, illustrating the pressing module being spaced apart from the circuit module.
Figure 11:
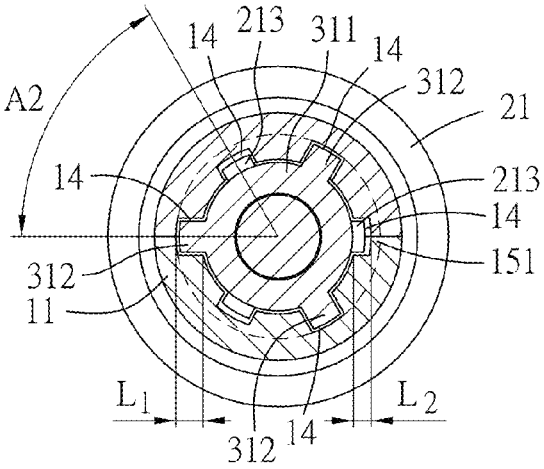
FIG. 11 is a sectional view of the pressing module, illustrating the driven member at a retracted position.
Figure 12:
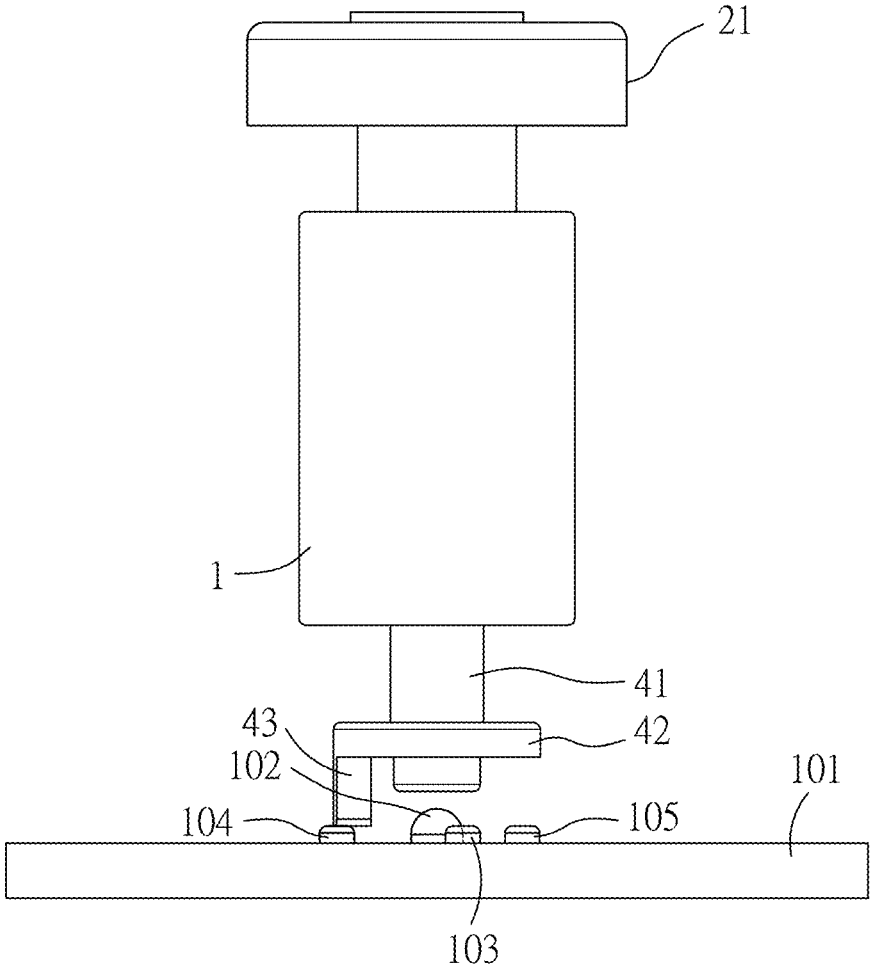
FIG. 12 is another side view of the embodiment, illustrating the pressing module pressing one of pushbuttons of the circuit module.
Figure 13:
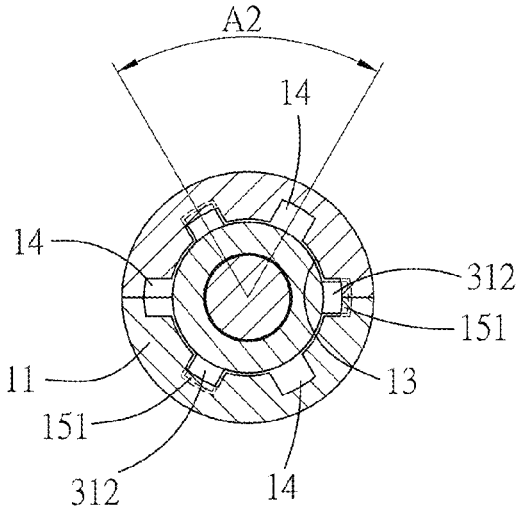
FIG. 13 is another sectional view of the pressing module, illustrating the driven member at a projecting position.

Referring to FIGS. 10 to 14, in this embodiment, there are six guide grooves 14 including three deep ones and three shallow ones that are disposed in alternating arrangement. The driven member 31 has three protruding blocks 312. Through one depression of the operating member 21, each protruding block 312 moves from one of the deep ones of the guide grooves 14 onto the end surface 151 of one of the connecting wall 15, or from the end surface 151 of one of the connecting wall 15 into one of the deep ones of the guide grooves 14. As shown in FIGS. 10 and 11, When the protruding blocks 312 correspond respectively in angular position to the deep ones of the guide grooves 14, the driven member 31 is urged by the resilient member 32 of the driven unit 3 to a retracted position where the protruding blocks 312 are respectively received in the deep ones of the guide grooves 14, where the flange section 42 abuts against the casing 1, and where the pressing section 43 is spaced apart from the pushbuttons 103, 104, 105. As shown in FIGS. 12 to 13, when the protruding blocks 312 correspond respectively in angular position to the shallow ones of the guide grooves 14, the driven member 31 is urged by the resilient member 32 of the driven unit 3 to a projecting position where the end surfaces 3121 of the protruding blocks 312 respectively abut against the end surfaces 151 of the connecting walls 15, and where the pressing section 43 presses against one of the pushbuttons 103, 104, 105, such that one of the colors of the light corresponding to the one of the pushbuttons 103, 104, 105 is visible through the operating section 211 of the operating member 21. The retracted position is closer to the first end opening 121 than the projecting position.

In other words, the driven member 31 rotates by the rotational angle (A2) in response to each depression of the operating section 211 of the operating member 21, and is moved alternately to the retracted position and the projecting position as a result of rotating by the rotational angle (A2) to allow the pressing section 43 to move between a release position where it is spaced apart from the pushbuttons 103, 104, 105 and a pressing position where it presses against one of the pushbuttons 103, 104, 105 respectively.

Figure 14:
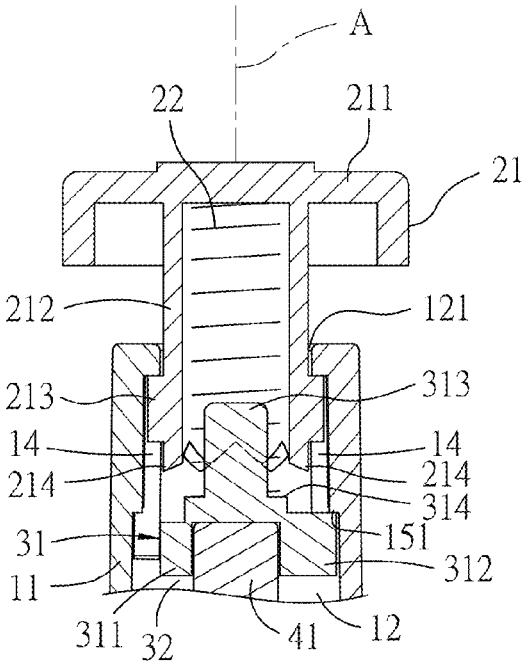
FIG. 14 is a fragmentary sectional view, illustrating the driven member at the projecting position.

Referring to FIG. 14, when the driven member 31 is at the projecting position, the operating member 21 is biased by the resilient member 22 of the operating unit 2 to the normal position.

In this embodiment, the casing 1 of the pressing module 200 may be connected fixedly to a casing (not shown) of the electronic apparatus, and the circuit module 100 may be electrically coupled to a control system (not shown) of the electronic apparatus to activate the functions of the electronic apparatus.

To sum up, the switch device of this disclosure is capable of switching and indicating a status of an electronic apparatus, and there is no need of additional display interface.

While the present disclosure has been described in connection with what is considered the most practical embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A switch device comprising:

a circuit module including a circuit board, a light-emitting member that is disposed on said circuit board, and a plurality of angularly spaced-apart pushbuttons that are disposed on said circuit board, and that surround said light-emitting member, said pushbuttons being capable of being pressed to activate said light-emitting member to emit light having different colors that correspond respectively to said pushbuttons; and a pressing module including a casing that defines a through hole therethrough, said through hole extending along an axis and having first and second end openings that are opposite to each other along the axis, said through hole being aligned with said light-emitting member, said second end opening being disposed between said first end opening and said light-emitting member, an operating unit that is partially mounted in and movable along said through hole, and that includes an operating section disposed outwardly of said through hole near said first end opening for being pressed, said operating section being at least partially transparent, a driven unit that includes a driven member mounted in said through hole and being movable along and rotatable about the axis, said operating unit pushing said driven member upon pressing said operating section, said driven member rotating by a rotational angle in response to each depression of said operating section, and being moved alternately to a retracted position and a projecting position as a result of rotating by the rotational angle, the retracted position being closer to said first end opening than the projecting position, and a pressing member that is connected fixedly to said driven member, and that has a pressing section disposed outwardly of said through hole near said second end opening, said pressing section pressing one of said pushbuttons when said driven member is at the projecting position, such that one of the colors of the light corresponding to the one of said pushbuttons is visible through said operating section of said operating unit, said pressing section being spaced apart from said pushbuttons when said driven member is at the retracted position, wherein said casing has a surrounding wall and a plurality of angularly spaced-apart guide ribs, and any two adjacent ones of said guide ribs cooperatively defining a guide groove therebetween, and said guide grooves between said guide ribs are divided into deep ones, and shallow ones that are shallower than the deep ones in a radial direction of said through hole.

2. The switch device as claimed in claim 1, wherein:

said surrounding wall that has an inner surrounding surface defining said through hole, and said guide ribs that are formed on said inner surrounding surface, each of said guide ribs extending from a position proximate to said first end opening toward said second end opening in a direction parallel to the axis, and having a spirally-extending end surface that faces toward said second end opening; and said driven member is urged toward said first end opening, and has a plurality of angularly spaced-apart protruding blocks, each of said protruding blocks having a spirally-extending end surface that faces toward said first end opening, said end surfaces of said protruding blocks being movable on said end surfaces of said guide ribs to rotate said driven member about the axis, said driven member of said driven unit further has a ring body, and said protruding blocks protruding radially and outwardly from said ring body.

3. The switch device as claimed in claim 2, wherein:

the deep ones and shallow ones of said guide grooves being disposed in alternating arrangement, said casing further having a plurality of connecting walls that are formed on said inner surrounding surface, each of said connecting walls being connected between and thinner than two adjacent ones of said guide ribs, each of said connecting walls defining a bottom wall surface of a respective one of said shallow ones of said guide grooves, each of said connecting walls having a spirally-extending end surface that faces toward said second end opening and that is connected to said end surface of one of the two adjacent ones of said guide ribs; and a protruding length of each of said protruding blocks in the radial direction being substantially equal to the depth of the deep ones of said guide grooves, said protruding blocks being respectively received in the deep ones of said guide grooves when said driven member is at the retracted position, said protruding blocks corresponding respectively in angular position to the shallow ones of said guide grooves so that said end surfaces of said protruding blocks respectively abut against said end surfaces of said connecting walls when said driven member is at the projecting position.

4. The switch device as claimed in claim 3, wherein said driven unit further includes a resilient member that is disposed between said casing and said driven member for urging said driven member toward said first end opening.

5. The switch device as claimed in claim 4, wherein said operating unit further includes an operating member that has:

a tubular section partially disposed in said casing and having an end that is connected to said operating section, and an opposite end that is opposite to said operating section and that is formed with a plurality of sharp teeth, and a plurality of angularly spaced-apart sliding blocks protruding radially and outwardly from said tubular section, corresponding respectively in angular position to said teeth, and being retained respectively and slidably in said guide grooves so as to guide said operating member to move along the axis between a normal position where said teeth are farther from said second end opening than said end surfaces of said guide ribs, and a pressed position where said teeth are closer to said second end opening than said end surfaces of said guide ribs to push said driven member, so that said end surfaces of said protruding blocks of said driven member are able to be urged by said resilient member of said driven unit to move onto said end surfaces of said guide ribs to drive rotation of said driven member.

6. The switch device as claimed in claim 5, wherein said operating unit further includes a resilient member disposed between said operating member and said driven member for biasing said operating member toward the normal position.

7. The switch device as claimed in claim 6, wherein said pressing member further has:

a rod section that has an end connected fixedly to said driven member, and an opposite end opposite to said driven member and projecting outwardly of said through hole via said second end opening, and a flange section that extends radially and outwardly from said opposite end of said rod section and that abuts against said casing when said driven member is at the retracted position, said pressing section projecting from an outer periphery of said flange section in a direction away from said driven member.

8. The switch device as claimed in claim 7, wherein said casing is formed with an inner flange, said resilient member of said operating unit and said resilient member of said driven unit being configured as compression springs, said resilient member of said driven unit surrounding said rod section of said pressing member and being sandwiched between said driven member and said inner flange of said casing.

9. The switch device as claimed in claim 8, wherein said driven member further has:

a cylindrical section that has an outer periphery connected to an inner periphery of said ring body and that is located between said ring body and said operating section of said operating member, and a column section that extends from a central portion of said cylindrical section toward said operating section, said resilient member of said operating unit being sandwiched between said cylindrical section and said operating section of said operating member, said column section extending into said resilient member of said operating unit.

10. The switch device as claimed in claim 2, wherein said driven unit further includes a resilient member that is disposed between said casing and said driven member for urging said driven member toward said first end opening.

11. The switch device as claimed in claim 10, wherein said operating unit further includes an operating member that has:

a tubular section partially disposed in said casing and having an end that is connected to said operating section, and an opposite end that is opposite to said operating section and that is formed with a plurality of sharp teeth, and a plurality of angularly spaced-apart sliding blocks protruding radially and outwardly from said tubular section, corresponding respectively in angular position to said teeth, and being retained respectively and slidably in said guide grooves so as to guide said operating member to move along the axis between a normal position where said teeth are farther from said second end opening than said end surfaces of said guide ribs, and a pressed position where said teeth are closer to said second end opening than said end surfaces of said guide ribs to push said driven member, so that said end surfaces of said protruding blocks of said driven member are able to be urged by said resilient member of said driven unit to move onto said end surfaces of said guide ribs to drive rotation of said driven member.

12. The switch device as claimed in claim 11, wherein said operating unit further includes a resilient member disposed between said operating member and said driven member for biasing said operating member toward the normal position.

13. The switch device as claimed in claim 12, wherein said pressing member further has:

a rod section that has an end connected fixedly to said driven member, and an opposite end opposite to said driven member and projecting outwardly of said through hole via said second end opening, and a flange section that extends radially and outwardly from said opposite end of said rod section and that abuts against said casing when said driven member is at the retracted position, said pressing section projecting from an outer periphery of said flange section in a direction away from said driven member.

14. The switch device as claimed in claim 13, wherein said casing is formed with an inner flange, said resilient member of said operating unit and said resilient member of said driven unit being configured as compression springs, said resilient member of said driven unit surrounding said rod section of said pressing member and being sandwiched between said driven member and said inner flange of said casing.

15. The switch device as claimed in claim 2, wherein said operating unit further includes:

an operating member that has a tubular section partially disposed in said casing and having an end that is connected to said operating section, and an opposite end that is opposite to said operating section and that is formed with a plurality of sharp teeth, and a plurality of angularly spaced-apart sliding blocks protruding radially and outwardly from said tubular section, corresponding respectively in angular position to said teeth, and being retained respectively and slidably in said guide grooves so as to guide said operating member to move along the axis between a normal position where said teeth are farther from said second end opening than said end surfaces of said guide ribs, and a pressed position wherein said teeth are closer to said second end opening than said end surfaces of said guide ribs to push said driven member, so that said end surfaces of said protruding blocks of said driven member are able to be urged to move onto said end surfaces of said guide ribs to drive rotation of said driven member, and a resilient member that is disposed between said operating member and said driven member for biasing said operating member toward the normal position.

16. The switch device as claimed in claim 15, wherein said pressing member further has a rod section that has an end connected fixedly to said driven member, and an opposite end opposite to said driven member and projecting outwardly of said through hole via said second end opening, and a flange section that extends radially and outwardly from said opposite end of said rod section and that abuts against said casing when said driven member is at the retracted position, said pressing section projecting from an outer periphery of said flange section in a direction away from said driven member.

* * * * *